US011826627B2

(12) United States Patent
Yoon

(10) Patent No.: US 11,826,627 B2
(45) Date of Patent: Nov. 28, 2023

(54) PUTTING GUIDE

(71) Applicant: GF CO., LTD., Anyang-si (KR)

(72) Inventor: Jeong Min Yoon, Anyang-si (KR)

(73) Assignee: GF CO., LTD., Anyang-si (KR)

( * ) Notice: Subject to any disclaimer, the term of this patent is extended or adjusted under 35 U.S.C. 154(b) by 22 days.

(21) Appl. No.: 17/697,139

(22) Filed: Mar. 17, 2022

(65) Prior Publication Data

US 2023/0226426 A1 Jul. 20, 2023

(30) Foreign Application Priority Data

Jan. 18, 2022 (KR) ..... 10-2022-0007005

(51) Int. Cl.
*A63B 69/36* (2006.01)

(52) U.S. Cl.
CPC ..... *A63B 69/3685* (2013.01); *A63B 69/3617* (2013.01); *A63B 69/3676* (2013.01); *A63B 69/3682* (2020.08)

(58) Field of Classification Search
CPC . A63B 69/36; A63B 69/3617; A63B 69/3676; A63B 69/0002; A63B 69/0008; A63B 69/3685; A63B 69/3614; A63B 69/3655; A63B 69/3682
USPC ..... 473/143
See application file for complete search history.

(56) References Cited

U.S. PATENT DOCUMENTS 3,165,930 A * 1/1965 Halpern ..... A63B 69/3676 473/143
3,788,646 A * 1/1974 Rawson ..... A63B 69/3688 473/200
4,209,172 A * 6/1980 Yamamoto ..... A63B 69/3685 473/200
4,411,431 A * 10/1983 Judice ..... A63B 69/3688 473/200
5,190,284 A * 3/1993 Diaz ..... A63B 69/3621 473/267
5,409,228 A * 4/1995 Botsch ..... A63B 69/3685 473/254
5,503,395 A * 4/1996 Cook ..... A63B 69/36211 473/268
6,231,459 B1 * 5/2001 Pettigrew ..... A63B 69/3688 473/266
6,416,420 B1 * 7/2002 Stark ..... A63B 69/3676 473/266
6,746,339 B1 * 6/2004 Thibaudeau ..... A63B 69/3682 473/267
7,285,054 B1 * 10/2007 Morrision ..... A63B 71/06 473/149
8,162,773 B1 * 4/2012 Pingalore ..... G01B 5/0023 473/231
9,044,645 B2 * 6/2015 Koleoglou ..... A63B 37/00223
(Continued)

FOREIGN PATENT DOCUMENTS

KR 20-0197074 Y1 9/2000

*Primary Examiner* — John E Simms, Jr.
(74) *Attorney, Agent, or Firm* — Hauptman Ham, LLP

(57) ABSTRACT

The present invention provides a putting guide capable of correcting a posture when putting, checking a contact angle between a putter and a golf ball, correcting a posture of an exerciser during a putting practice, and checking a focusing point that the exerciser watches.

The putting guide for putting practice includes a hitting part, a rod part connected to the hitting part, and a front part formed on an end of the rod part.

7 Claims, 6 Drawing Sheets

(56) References Cited

U.S. PATENT DOCUMENTS

| | | | | |
|---|---|---|---|---|
| 9,457,254 | B1 * | 10/2016 | Grill | A63B 69/3658 |
| 9,993,714 | B1 * | 6/2018 | Grill | A63B 69/3688 |
| 10,751,599 | B1 * | 8/2020 | Whitfield | A63B 69/3676 |
| 2002/0111224 | A1 * | 8/2002 | Sweinhart | A63B 69/3676<br>473/257 |
| 2011/0151984 | A1 * | 6/2011 | Prater | A63B 69/3623<br>473/409 |
| 2017/0106265 | A1 * | 4/2017 | Bryant | A63B 69/3676 |
| 2020/0330846 | A1 * | 10/2020 | Dungan | A63B 69/3688 |

* cited by examiner

PUTTING GUIDE

CROSS-REFERENCE TO RELATED APPLICATIONS

This U.S. non-provisional patent application claims priority under 35 U.S.C. § 119 of Korean Patent Application No. 10-2022-0007005, filed on Jan. 18, 2022, the entire contents of which are hereby incorporated by reference.

BACKGROUND

The present invention relates to a putting guide that is used for a putting practice of golf and capable of effectively performing the putting practice.

Golf that is an exercise performed without significant restrictions on physical conditions has an advantage in that the golf may be performed alone and also strengthen human bond while exercising. Accordingly, a gold population rapidly increases domestically and internationally.

Also, a golf club used for the golf has a simple structure including a rod-shaped support having a grip part and a head formed on a lower end of the support for acting an external force to a golf ball. The golf club itself may not adjust a direction of the golf ball, a hitting accuracy and a driving distance, which are affected by a posture and a movement of an exerciser.

However, most golfers, particularly beginners, are unaware to have a body posture shaken or changed during a swing movement or a putting movement. Thus, the golfers may not exactly hit the golf ball and also may not control a force, so that the golf ball does not travel as far as a desired driving distance or in a desired direction.

In order to solve the above-described limitation, Korean Utility Model Registration No. 20-0197074 discloses a golf club including a reference position bar 20 for adjusting a position so that a putting head 12 is aligned to a golf ball to be hit by the putting head 12.

However, the disclosed device still has an inefficient limitation in that the device has a complicated configuration and is not able to correct a posture of an exerciser or a visual aspect such as a focusing point.

SUMMARY

The present invention provides a putting guide capable of correcting a posture when putting, checking a contact angle between a putter and a golf ball, correcting a posture of an exerciser during a putting practice, and checking a focusing point that the exerciser watches.

An embodiment of the present invention provides a putting guide for putting practice, including: a hitting part that is hit by a putter head; a rod part connected to the hitting part; and a front part formed on an end of the rod part.

In the putting guide of the present invention, the hitting part may have first, second, third and fourth top surfaces extending in a longitudinal direction thereof and a side surface perpendicular to the first, second, third and fourth top surfaces.

In the putting guide of the present invention, each of the first, second, third and fourth top surfaces of the hitting part may have a length equal to a diameter (d) of a golf ball.

In the putting guide of the present invention, the side surface of the hitting part may have a square shape and a size equal to or less than the diameter (d) of the golf ball.

In the putting guide of the present invention, the hitting part may have a different color or is made of a different material to be distinguished from the rod part.

In the putting guide of the present invention, a reflection part may be formed on the first top surface that is one of the first, second, third and fourth top surfaces of the hitting part.

In the putting guide of the present invention, the reflection part may be fixed as the reflection part is attached to the first top surface.

In the putting guide of the present invention, the reflection part may be fixed as the reflection part is inserted and buried into the first top surface.

In the putting guide of the present invention, the reflection part may be fixed as the reflection part is buried to have a height less than that of the first top surface.

In the putting guide of the present invention, first, second and third reference points may be respectively marked on the rest second, third and fourth top surfaces on which the reflection part is not formed among the four top surfaces of the hitting part, the first reference point formed on the second top surface may be disposed closest to the side surface of the hitting part in a longitudinal direction of the putting guide, the second reference point formed on the third top surface may be disposed in the middle from the side surface of the hitting part in the longitudinal direction, and the third reference point formed on the fourth top surface may be disposed farthest from the side surface of the hitting part in the longitudinal direction.

In the putting guide of the present invention, a plurality of points arranged in the longitudinal direction of the first, second and third reference points may be formed.

In the putting guide of the present invention, the front part may have a cross-section that gradually decreases in size in a direction toward an end thereof.

BRIEF DESCRIPTION OF THE FIGURES

The accompanying drawings are included to provide a further understanding of the inventive concept, and are incorporated in and constitute a part of this specification. The drawings illustrate embodiments of the inventive concept and, together with the description, serve to explain principles of the inventive concept. In the drawings.

DETAILED DESCRIPTION

Hereinafter, an embodiment of the present invention will be described with reference to the accompanying drawings.

Figure 1:
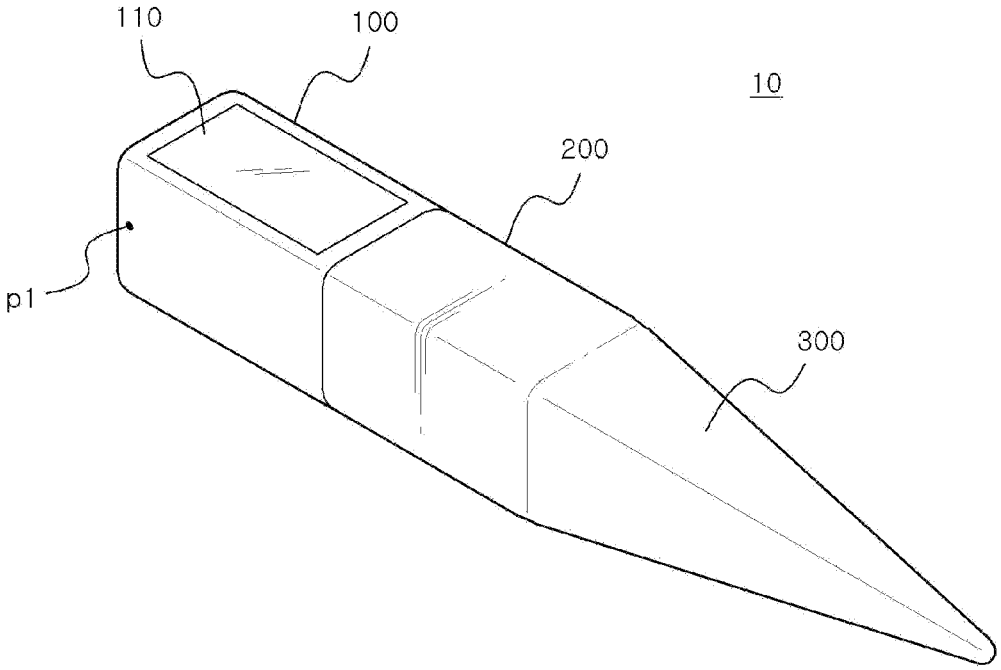
FIG. 1 is a perspective view illustrating a putting guide according to an embodiment of the present invention.
Figure 2:
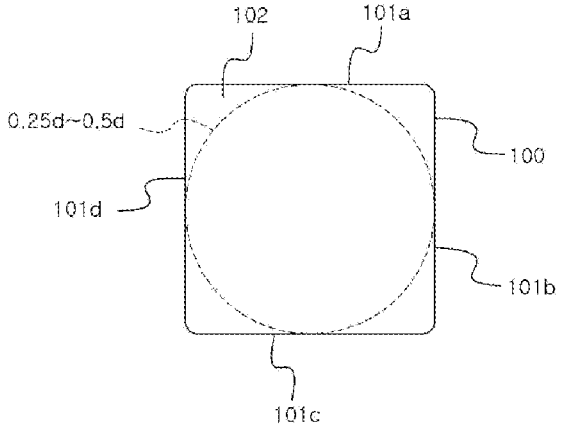
FIG. 2 is a side view illustrating the putting guide according to an embodiment of the present invention.
Figure 3:
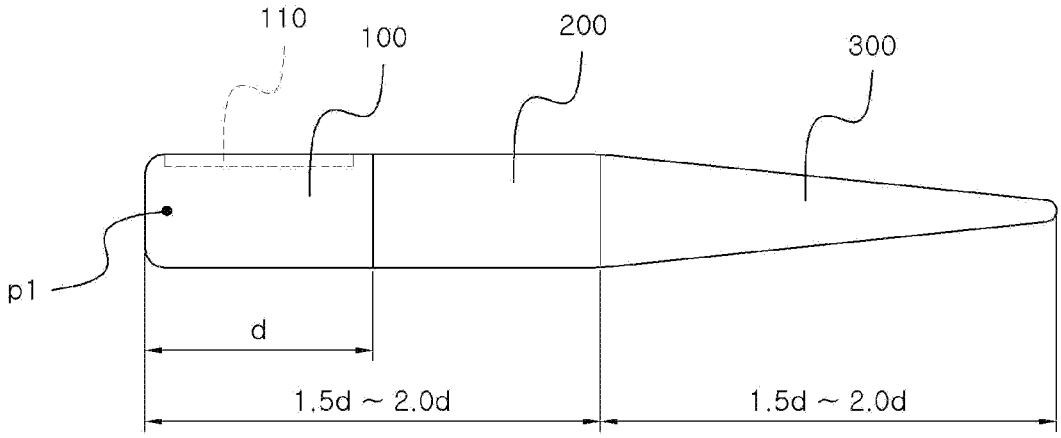
FIG. 3 is a front view illustrating the putting guide according to an embodiment of the present invention.

FIG. 1 is a perspective view illustrating a putting guide according to an embodiment of the present invention. FIG. 2 is a perspective view illustrating the putting guide according to an embodiment of the present invention. FIG. 3 is a front view illustrating the putting guide according to an embodiment of the present invention.

A putting guide 10 according to the present invention includes a hitting part 100, a rod part 200 connected to the hitting part 100, and a front part 300 connected to the rod part 200.

The embodiment of the present invention is not limited to the material of the putting guide 10. For example, the putting guide 10 may be made of a wood or a synthetic resin material.

According to the present invention, the hitting part 100 has four top surfaces 101*a*, 101*b*, 101*c* and 101*d* and a side surface 102, which are perpendicular to each other.

The side surface 102 of the hitting part 100 may have a square shape and a size equal to a diameter d of a golf ball to give a feeling similar to that of the golf ball.

Alternatively, since all of the diameter d of the golf ball is not used in substantial putting, the side surface 102 of the hitting part 100 may have a size of 0.25d to 0.5d similarly to a substantially hit size.

Each of the four top surfaces 101*a*, 101*b*, 101*c* and 101*d* has a length equal to the diameter d of the golf ball to give a feeling similar to that of the golf ball.

Since the side surface 102 is perpendicular to the four top surfaces 101*a*, 101*b*, 101*c* and 101*d* in the hitting part 100, the side surface forms an angle perpendicular to the floor when the putting guide 10 is disposed on the floor.

The hitting part 100 may be colored or made of a different material to distinguish the hitting part 100 from the rod part 200 and the front part 300.

In this embodiment, the four top surfaces 101*a*, 101*b*, 101*c* and 101*d* of the hitting part 100 is colored with a white color to give a feeling of the golf ball.

Alternatively, the hitting part 100 may be formed to express a groove formed in a surface of the golf ball on a white colored surface to further give a feeling of practicing with a real golf ball.

Also, a reflection part 110 is installed on one of the four top surfaces 101*a*, 101*b*, 101*c* and 101*d* of the hitting part 100.

In this embodiment, the reflection part 110 is formed on a first top surface 101*a*.

The embodiment of the present invention, the reflection part 110 is configured as mirror. But reflection part can be configured as other parts as long as the reflection part reflects a shape of an exerciser so that the exercise may see the reflected shape.

In an embodiment of the present invention, the reflection part 110 may have a size equal to or slightly less than that of the first top surface 101*a* and be attached to the first top surface 101*a*.

In another embodiment of the present invention, the reflection part 110 may have a size slightly less than that of the first top surface 101*a* and be buried into and fixed to the first top surface 101*a*.

When the reflection part 110 is formed at the first top surface 101*a* by a burial method, the burial method may exhibit an advantageous effect in terms of fixing of the reflection part 100 in comparison with a case of attaching the reflection part 110 to the first top surface 101*a*.

Also, even when the reflection part 110 is formed at the first top surface 101*a* by using the burial method, a top surface of the reflection part 110 may be less in height than the first top surface 101*a*.

In this case, a surface damage of the reflection part 110 caused by friction between a floor surface and the reflection part 110 when the putting guide 10 is frequently used may be prevented. Thus, this case may exhibit an advantageous effect in that an appearance of the exercise is clearly reflected by the reflection part 110.

Figure 4:
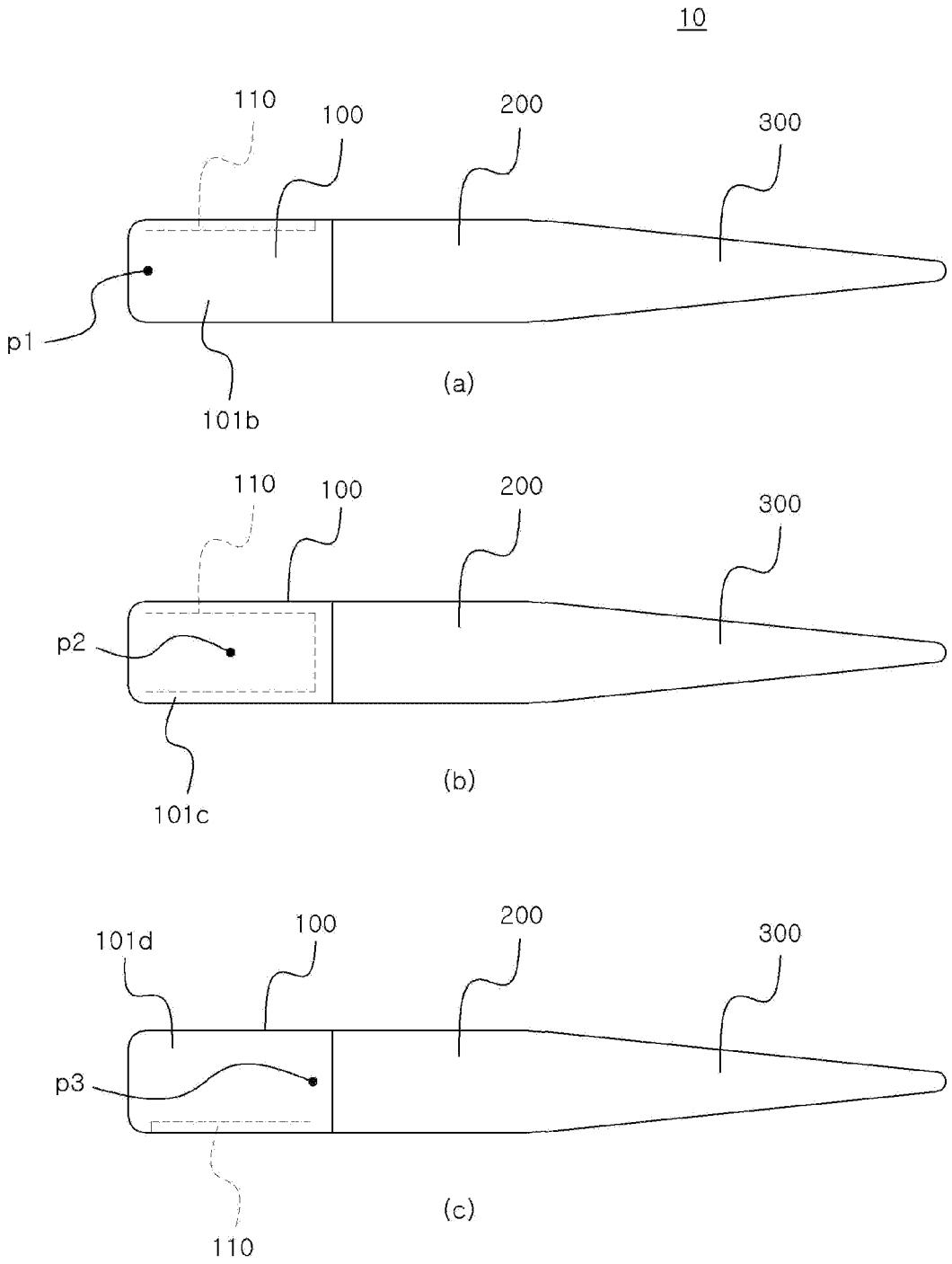
FIG. 4 is a view illustrating a state in which a focusing reference point is marked on the putting guide according to an embodiment of the present invention.

FIG. 4 is a view illustrating a state in which a focusing reference point is marked on the putting guide according to an embodiment of the present invention.

First, second and third reference points p1, p2 and p3 are respectively marked on the rest second, third and fourth top surfaces 101*b*, 101*c* and 101*d* on which the reflection part 110 is not formed among the first, second, third and fourth top surfaces 101*a*, 101*b*, 101*c* and 101*d*.

The first reference point p 1 formed on the second top surface 101*b* is formed closest to the side surface of the hitting part 100 in a longitudinal direction thereof, the second reference point p2 formed on the third top surface 101*c* is formed in the middle from the side surface of the hitting part 100 in the longitudinal direction, and the third reference point p3 formed on the fourth top surface 101*d* is formed farthest from the side surface of the hitting part 100 in the longitudinal direction.

Each of the first, second, and third reference points p1, p2 and p3 are positioned in the middle of a height direction of each of the second, third and fourth top surfaces 101*b*, 101*c* and 101*d* and forms the same distance in the longitudinal direction.

Although only one reference point is marked on each top surface in this embodiment, the embodiment of the present invention is not limited thereto. For example, a plurality of reference points may be marked for each top surface to select an exact reference point of the exerciser.

When the plurality of reference points are marked, the plurality of reference points may have different colors or sizes for distinguishment.

The rod part 200 may have a shape for naturally connecting a flow from the square-shaped hitting part 100 to the cone-shaped front part 300.

The rod part 200 typically has a length of 1.5 d to 2.0 d (d: the diameter of the golf ball) including the hitting part 100.

The front part 300 is formed such that a size of a cross-section thereof gradually decreases in a direction toward a front end thereof so as to reduce air resistance when the putting guide moves. In the present embodiment, the front part has a cone shape.

The front part 300 typically has a length of 1.5 d to 2.0 d (d: the diameter of the golf ball).

Hereinafter, a method for practicing putting by using the putting guide formed as described above will be described.

Figure 5:
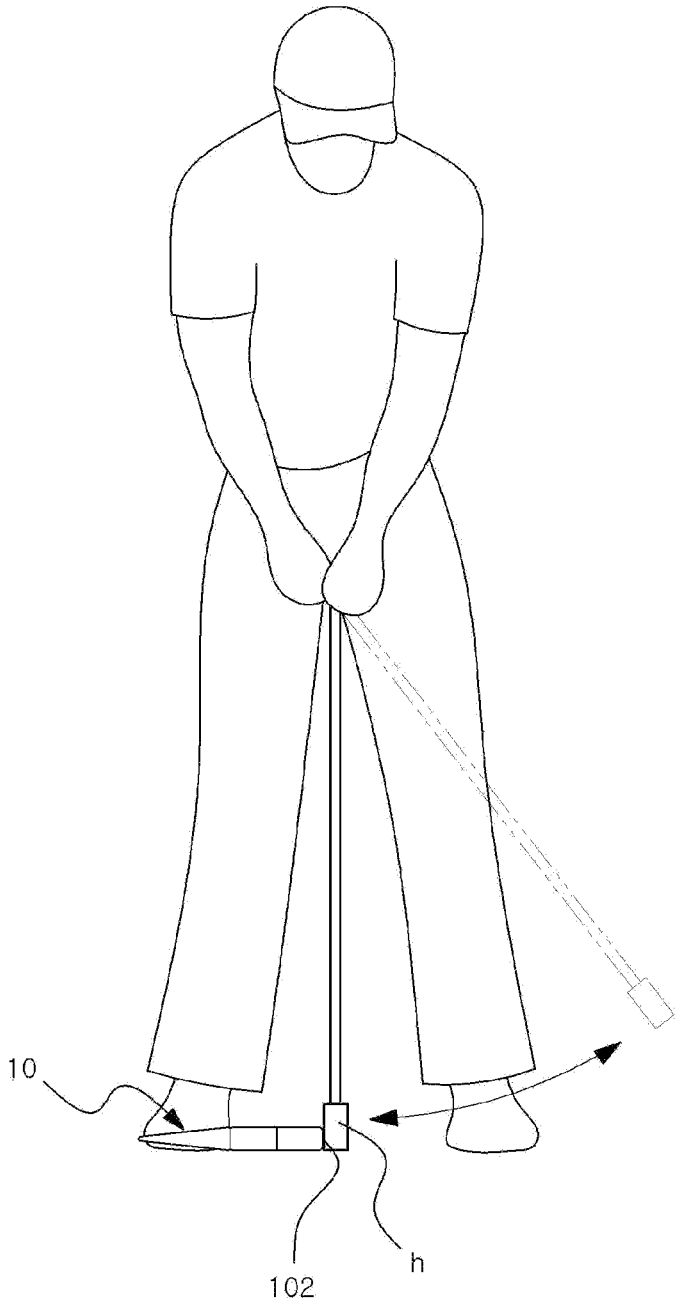
FIG. 5 is a view illustrating a state of correcting and practicing a putting head swing posture by using the putting guide according to an embodiment of the present invention.

FIG. 5 is a view illustrating a state of correcting and practicing a putting head swing posture by using the putting guide according to an embodiment of the present invention.

First, when a putting exerciser arranges the putting guide 10 on the floor surface, the side surface 102 of the hitting part 100 is disposed perpendicular to the floor surface.

In this state, when a practice of accurately aiming a hitting surface of a putter head h to the side surface 102 of the hitting part 100 is repeatedly performed, an effect of correcting a swing posture of a putter to exactly hit the putter head is obtained.

Particularly, since the size of the square shape of the hitting part 100 has the same size as the diameter d of the golf ball in the present invention, the same practicing effect as practicing with a real golf ball is obtained.

Figure 6:
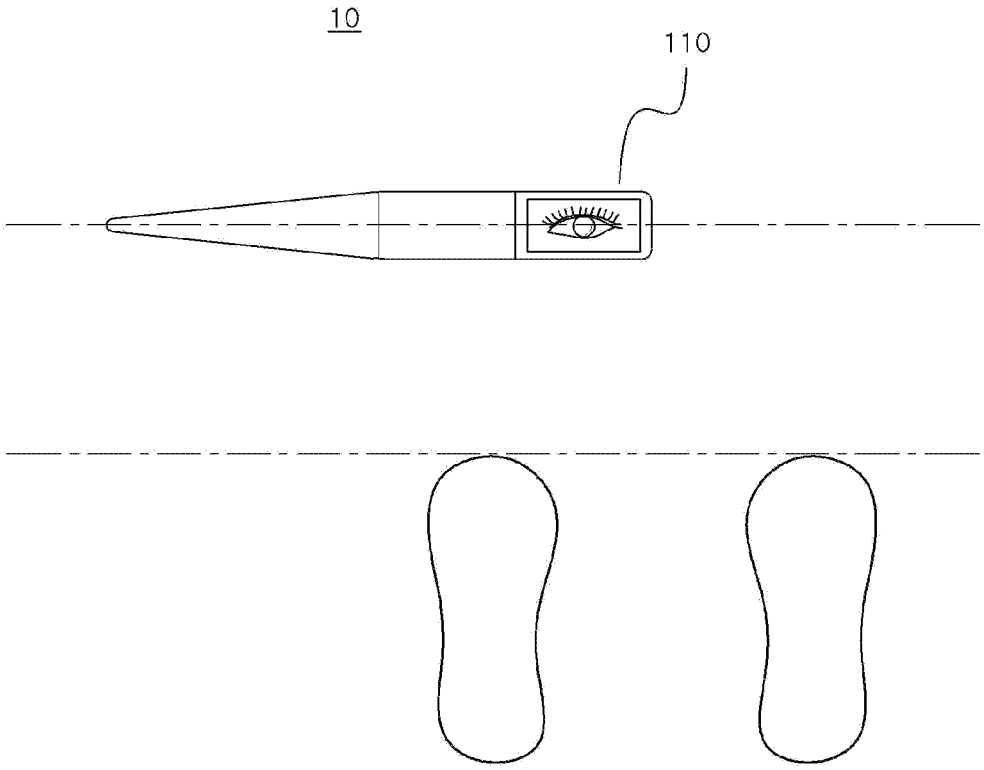
FIG. 6 is a view illustrating a state of correcting and practicing a putting posture by using the putting guide according to an embodiment of the present invention.

FIG. 6 is a view illustrating a state of correcting and practicing a putting posture by using the putting guide according to an embodiment of the present invention.

Since the reflection part 110 is installed on the putting guide according to the present invention, the putting exerciser naturally learns a practice of maintaining a correct putting posture through the reflection part 110.

Specifically, in case of a right-handed exerciser, a left eye is to be shown at a center of the reflection part 110 in the correct putting posture. While checking this through the reflection part 110, the exerciser may practice the correct putting posture.

On the contrary, a left-handed exerciser may practice the correct putting posture while checking whether a right eye is shown at the center of the reflection part 110.

Furthermore, the putting guide 10 according to the present invention has an advantageous effect of practicing an exact putting stance.

The putting exerciser may establish one virtual line by connecting ends of both feet and check whether the virtual line is parallel to the longitudinal direction of the putting guide 10.

Also, the side surface 102 of the putting guide 10 has to be positioned on a central line of the both feet in the putting stance, and this is also checked.

Through this, the exerciser may repeat a practice of checking the putting stance and exactly maintaining the putting stance to obtain an effect of practicing and correcting the putting stance.

Figure 7:
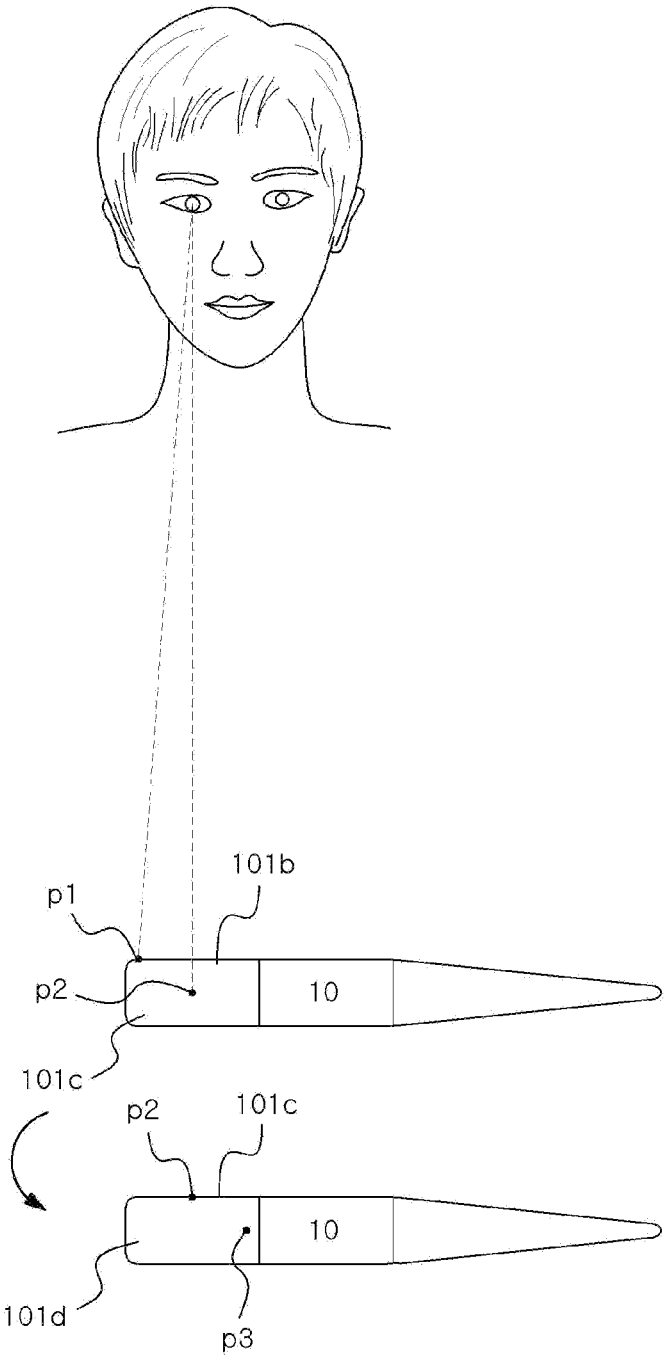
FIG. 7 is a view illustrating a state of finding a focusing point when putting by using the putting guide according to an embodiment of the present invention.

FIG. 7 is a view illustrating a state of finding a focusing point when putting by using the putting guide according to an embodiment of the present invention.

According to the present invention, the reference point for checking the focusing point when performing putting is formed on the hitting part 100.

For example, the exerciser arranges the putting guide 10 on the floor so that the third top surface 101*c* on which the second reference point p2 is marked is positioned at an upper portion of the putting guide 100.

Thereafter, the exerciser performs putting in a state in which vision of the exerciser is focused to the second reference point p2.

After performing the putting, whether the putting guide 100 moves in a straight direction is checked. When a movement direction of the putting guide 100 is not straight, the putting guide 100 is rotated so that the third top surface 101*c* is positioned at the upper portion.

Thereafter, while the vision is focused to the third reference point p2 marked on the third top surface 101*c*, the putting is performed again to check whether the putting guide 100 moves straight.

When the above-described method is performed by alternating the second, third and fourth top surfaces 101*b*, 101*c* and 101*d*, the focusing point that is the most proper to the exerciser and allows the putting guide 10 to move in the straight direction may be found.

When a plurality of reference points are formed on each top surface, the putting guide 100 may be more exactly used in case that, e.g., a point between the first reference point and the second reference point is the focusing point.

As described above, an effect of improving a putting accuracy may be obtained by exactly correcting a hitting angle of the putting head and exactly checking and correcting the focusing point of the putting while checking the stance and the position of eyes in the putting posture through the putting guide according to the present invention.

Also, since the putting guide according to the present invention is formed such that a surface contacting the floor surface is flat, and the rod part 200 including the hitting part 100 has the length of 1.5 d to 2.0 d, the putting guide may be prevented from moving too far during the putting practice regardless of a material of the floor surface.

Thus, an effect of reducing inconvenience of collecting the putting guide after the putting practice may be obtained regardless of the material of the floor in comparison with a case when the bottom surface of the putting guide has a spherical shape like a shape of the golf ball.

The putting exerciser may have the following advantageous effects by using the putting guide according to the present invention.

Since the side surface of the putting guide according to the present invention is perpendicular to the floor surface, the putting exerciser may have the effect of checking and correcting the feature of exactly hitting the hitting surface of the putter head to the putting guide.

Also, the present invention exhibits the advantageous effect in posture correction by correcting and maintaining the exact posture of the putting exerciser as the reflection part is formed on the top surface of the putting guide, and whether one eye of the exerciser is shown on the reflection part is checked.

Furthermore, the present invention exhibits the effect of correcting and improving the putting stance by correcting the stance so that the virtual line obtained by aligning end lines of the both feet during putting is parallel to the putting guide.

In addition, the present invention exhibits the advantageous effect of practicing how to set the hitting point to send the golf ball in the desired direction when the putting exerciser hits the golf ball by using the reference point of the putting guide.

Although the embodiments of the present invention have been described, it is understood that the present invention should not be limited to these embodiments but various changes and modifications can be made by one ordinary skilled in the art within the spirit and scope of the present invention as hereinafter claimed.

What is claimed is:

1. A putting guide for putting practice, comprising:

a hitting part that is hit by a putter head;

a rod part connected to the hitting part; and a front part formed on an end of the rod part, wherein the hitting part has first, second, third, and fourth top surfaces extending in a longitudinal direction thereof and a side surface perpendicular to the first, second, third, and fourth top surfaces, wherein each of the first, second, third, and fourth top surfaces of the hitting part has a length equal to a diameter (d) of a golf ball, wherein the side surface of the hitting part has a square shape and a size equal to or less than the diameter (d) of the golf ball, wherein the hitting part has a different color or is made of a different material to be distinguished from the rod part, and wherein a reflection part is formed on the first top surface that is one of the first, second, third, and fourth top surfaces of the hitting part.

2. The putting guide of claim 1, wherein the reflection part is fixed as the reflection part is attached to the first top surface.

3. The putting guide of claim 2, wherein the reflection part is fixed as the reflection part is inserted and buried into the first top surface.

4. The putting guide of claim 3, wherein the reflection part is fixed as the reflection part is buried to have a height less than that of the first top surface.

5. The putting guide of claim 4, wherein first, second and third reference points are respectively marked on the rest second, third and fourth top surfaces on which the reflection part is not formed among the four top surfaces of the hitting part, the first reference point formed on the second top surface is disposed closest to the side surface of the hitting part in a longitudinal direction of the putting guide, the second reference point formed on the third top surface is disposed in the middle from the side surface of the hitting part in the longitudinal direction, and the third reference point formed on the fourth top surface is disposed farthest from the side surface of the hitting part in the longitudinal direction.

6. The putting guide of claim 5, wherein a plurality of points arranged in the longitudinal direction of the first, second and third reference points are formed.

7. The putting guide of claim 6, wherein the front part has a cross-section that gradually decreases in size in a direction toward an end thereof.

* * * * *